United States Patent [19]

Hartmann et al.

[11] Patent Number: 4,739,733

[45] Date of Patent: Apr. 26, 1988

[54] DELIVERY TIMING REGULATOR

[75] Inventors: Ernst-Siegfried Hartmann, Overath; Werner Lemme, Roesrath; Eckhard Haas, Cologne, all of Fed. Rep. of Germany

[73] Assignee: Kloeckner-Humboldt-Deutz AG, Fed. Rep. of Germany

[21] Appl. No.: 898,990

[22] Filed: Aug. 19, 1986

[30] Foreign Application Priority Data

Aug. 23, 1985 [DE] Fed. Rep. of Germany ..... 3530134

[51] Int. Cl.[4] ..... F01L 1/34

[52] U.S. Cl. ..... 123/90.17; 123/90.6; 123/508

[58] Field of Search ..... 123/90.6, 90.17, 90.16, 123/508, 90.15

[56] References Cited

U.S. PATENT DOCUMENTS

| | | | |
|---|---|---|---|
| 2,057,354 | 10/1936 | Withers et al. | 123/90.17 |
| 3,142,996 | 8/1964 | Anderson | 123/90.6 |
| 4,332,222 | 6/1982 | Papez | 123/90.17 |
| 4,335,686 | 6/1982 | Herdin et al. | 123/90.6 |
| 4,463,712 | 8/1984 | Stojek et al. | 123/90.17 |
| 4,522,085 | 6/1985 | Kane | 123/90.17 |
| 4,561,390 | 12/1985 | Nakamura et al. | 123/90.17 |
| 4,590,905 | 5/1986 | Matsuki et al. | 123/90.17 |

FOREIGN PATENT DOCUMENTS 3224951 1/1984 Fed. Rep. of Germany .

*Primary Examiner*—Ira S. Lazarus

*Attorney, Agent, or Firm*—Charles L. Schwab

[57] ABSTRACT

A device for regulating the delivery timing of injector pump elements is presented, whereby the injection pump elements are actuated by a camshaft of the internal combustion engine, said camshaft also being simultaneously employed to operate the intake and exhaust valves. All the cams are nonrotatably secured to the camshaft and the entire camshaft is rotatively adjusted relative to the crankshaft by a delivery timing regulator.

1 Claim, 2 Drawing Sheets

| | | | |
|---|---|---|---|
| Injection | OPT | OPT | OPT |
| Valve Closing | $-2^o$ | | $+2^o$ |
| Timing | Closed Late | OPT | Closed Early |

DELIVERY TIMING REGULATOR

TECHNICAL FIELD

This invention relates to fuel injection and valve operating mechanisms for internal combustion engines and more particularly to use of a single camshaft to operate the fuel injectors and the intake and exhaust valves.

BACKGROUND OF THE INVENTION

For actuating injector pump elements, it is known that a sleeve with cams can be arranged on a camshaft of an internal combustion engine. In such prior construction, the sleeve is rotatable relative to the camshaft and is rotated relative thereto by a centrifugal governor responsive to the speed of the camshaft. This prior design is costly to construct. By using such an arrangement on multicylinder engines, the injector pump elements must be together in one unit in order that all of the injector pump elements are controlled by a common centrifugal governor. As a result of this type of design, the injector pump elements cannot be spaced in accordance with the respective corresponding injector nozzles, so that the length of the injector lines cannot be kept at a minimum, which is contrary to the requirements of injector technology.

OBJECTS AND SUMMARY OF THE INVENTION

A main object of this invention is the provision of a mechanism operating intake and exhaust valves and injector pump elements with a single camshaft which is of a simple mechanical construction and at the same time makes it possible to arrange the injector pump elements along the axial length of the camshaft at the optimum desired position.

In the fuel injection engine of this invention, a single camshaft includes cams fixedly secured thereto for rotation therewith which operate the intake and exhaust valves and also a fuel injection pump for each cylinder of the engine and a single delivery timing device operable to change the rotated position of the camshaft relative to the drive shaft in response to engine speed.

Inasmuch as the cams for actuating the injector pump elements are nonrotatably fixed on the camshaft and inasmuch as the delivery timing regulator rotates the entire camshaft relative to the drive shaft, a simpler mechanical construction of the entire drive train is achieved. Advantageously the cams for actuating the injector pump elements are machined and finished on the cast or forged camshaft in one manufacturing operation along with the intake and exhaust valve cams. The cams for actuating the injector pump elements can be positioned at convenient points along the axial length of the camshaft and, thus, the requirements for the camshaft can be met with regard to mechanical and dynamic characteristics and the positioning of the injector pump elements relative to the corresponding injection valves can be carried out in a simple manner. The fuel delivery timing regulator is advantageously integrated into the drive gear of the camshaft. Because of this, no special requirements are imposed on the delivery timing regulator and, therefore, a standard commercial delivery timing regulator may be employed. The delivery timing regulator can function on a mechanical, hydraulic or electrical basis.

Preferably, the cams for actuating the intake and exhaust valves and the injection pump elements are arranged with respect to each other and coordinated with the regulating characteristics of the delivery timing regulator such that at approximately average rpms between idle and the rated rpms of the internal combustion engine, the optimum regulated fuel delivery timing for the entire rpm range coincides with the optimal value for the intake and exhaust valve timing. This results from the fact that the fuel delivery timing, which is the determining factor for efficient combustion, is regulated at predetermined optimum values of performance over the entire rpm range of the internal combustion engine. Simultaneously, the optimum adjustment of the valve timing occurs at the average rpm of the engine which is the speed at which the engine produces its maximum torque. As a result, the control timing errors that result at both limiting rpm values are approximately half of the value of the total delivery timing adjustment. Such timing deviations, however, do not adversely affect the operation of the internal combustion engine. Of course, timing deviations to obtain approximately the optimum value over the entire rpm range, and within a specific tolerance range, have already been included in the basic design of the internal combustion engine. Consequently, with a design according to the invention, the advantage that results is that at a maximum torque speed, the valve timing does not deviate from the predetermined optimum setting.

BRIEF DESCRIPTION OF THE DRAWINGS

One embodiment of the invention is illustrated in the drawings, in which.

DETAILED DESCRIPTION OF THE DRAWINGS

Figure 1:
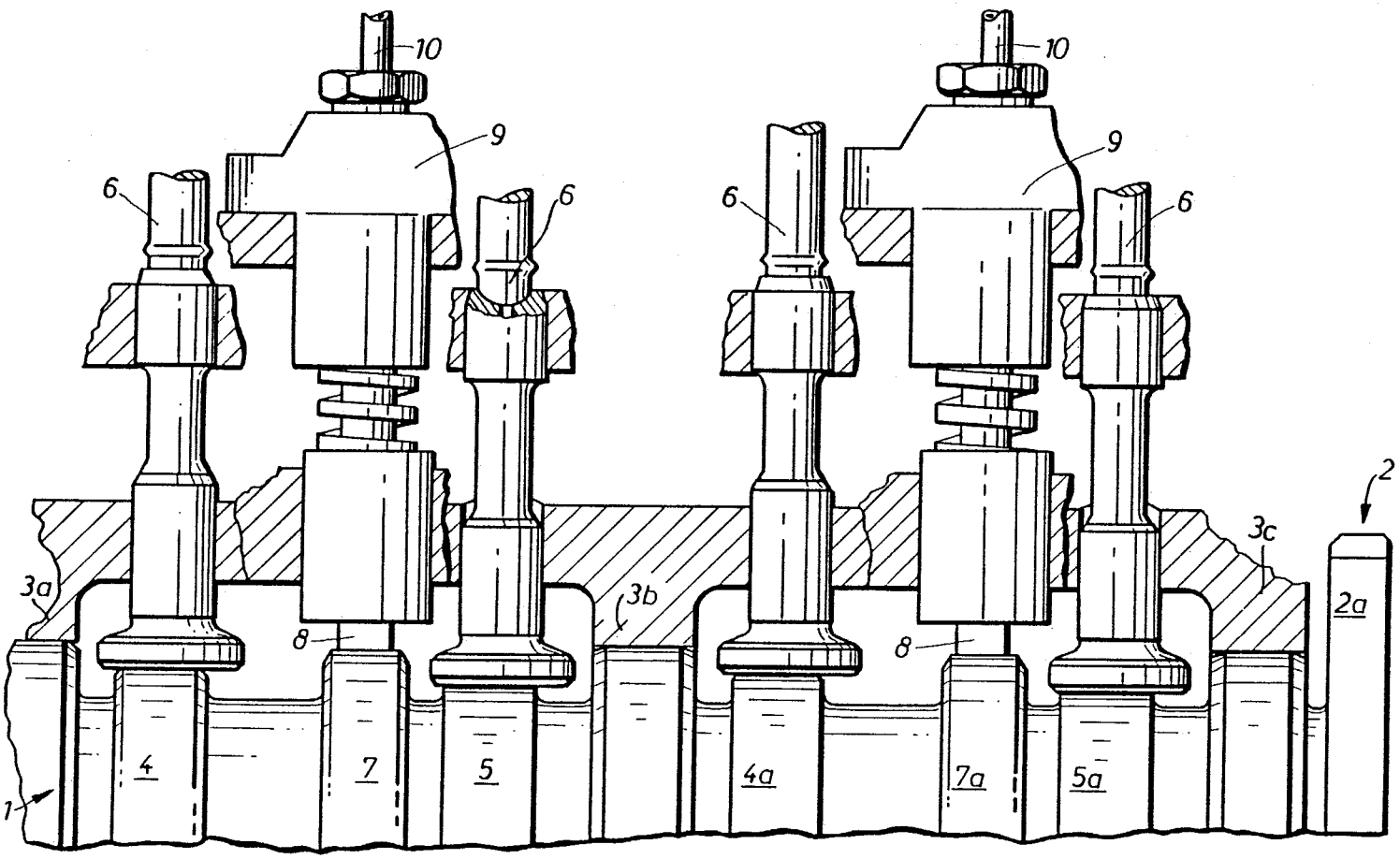
FIG. 1 is a partial section of an engine showing fuel delivery elements and intake and exhaust valve push rods associated with a single camshaft.

Referring to FIG. 1, a camshaft 1 of an internal combustion engine is driven through an engine driven driving component in the form of a drive gear 2 by the crankshaft, not shown, of an internal combustion engine at half the crankshaft speed. A delivery timing regulator 2*a* is integrated into the drive gear 2 on one end of the camshaft 1. The delivery timing regulator 2*a* rotates the cam shaft 1 up to 4 degrees relative to the radially outer ring gear portion of the drive gear 2, and consequently relative to the crankshaft, such rotative adjustment being dependent on the speed of the internal combustion engine. The camshaft 1 is supported along its axial length in bearings 3*a*, 3*b*, 3*c*. For actuation of the intake and exhaust valves for two cylinders of the engine, cams 4, 4*a*, 5, 5*a* are provided. Two push rods 6 for each cylinder engage, and are moved by, the outer circumference of the cams 4, 4*a*, 5, 5*a* to actuate the intake and exhaust valves of the internal combustion engine.

For each cylinder of the internal combustion engine, a third cam 7 or 7*a* is provided on the camshaft 1. The outer circumference of each cam 7, 7*a* contacts a push rod 8 which in turn contacts a reciprocable injection pump element of a fuel injection pump 9. Each of the injection pumps 9 is provided with fuel in a nonillustrated manner, said fuel being delivered by the pumping action of the pump 9 through the partially illustrated injection lines 10 which extend to the corresponding injector nozzles, not shown, at the respective cylinders.

Figure 2:
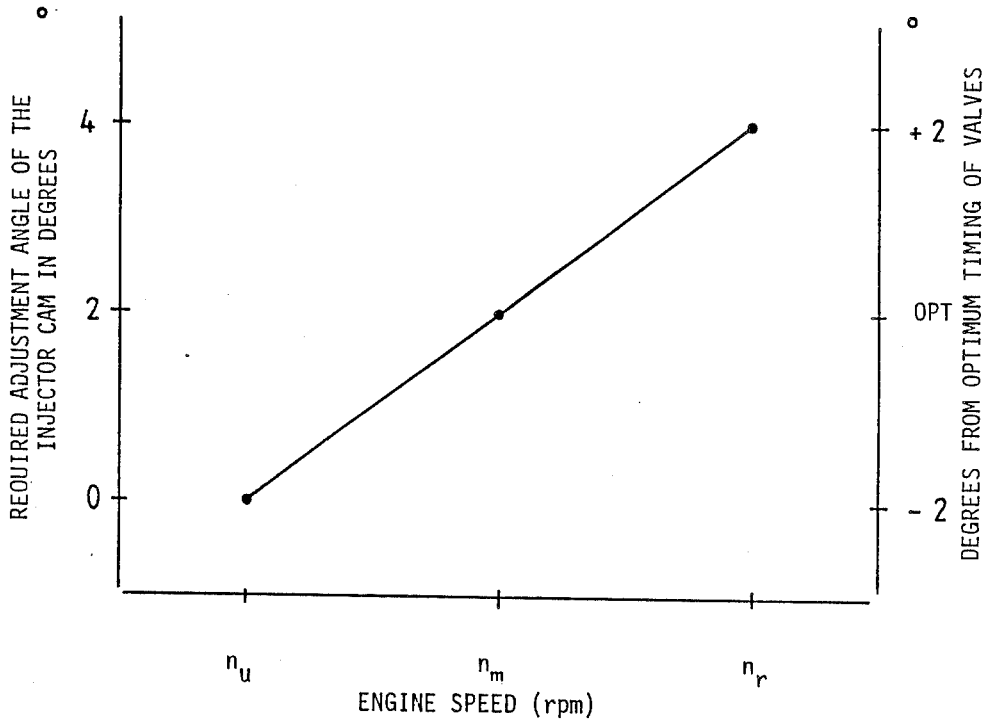
FIG. 2 is a graph showing the correlation of the fuel delivery and valve timing.

Referring to FIG. 2, the angular adjustment of the camshaft versus the speed of the internal combustion engine is illustrated graphically. The left side of the graph represents the angular adjustment of the injector cams 7, *7a* in degrees. On the right side of the diagram, the appropriate correlation of the timing for the intake and exhaust valves of the internal combustion engine is recorded. From the diagram it can be seen that the optimal valve and fuel timing lies approximately at the midpoint of the engine speed between the idle rpm value $n_u$ and the rated rpm value $n_r$ and corresponds to the rpm value at which maximum torque $n_m$ exists. Upon viewing the table in FIG. 2, it can be seen that the fuel delivery timing, and consequently the injection, is optimum at all rpm values, while the timing of the intake and exhaust valves is optimum at average rpms. At idle speed $n_u$, the valve timing occurs 2 degrees of camshaft angle too late and at rated speed $n_r$, the valve timing occurs 2 degrees of camshaft angle too early, which has no negative influence on the operational characteristics of the internal combustion engine.

The embodiments of the invention in which an exclusive property or privilege is claimed are defined as follows:

1. In combination with an internal combustion engine having a maximum torque speed intermediate its idle and rated speeds and including intake and exhaust valves and at least one injection pump element for each of its cylinders, a mechanism for regulating fuel delivery timing and the timing of the opening and closing of said valves comprising a unitary camshaft including cams nonrotatably secured thereto for individually operating, respectively, said intake valve, said exhaust valve and said injection pump element, said cams controlling the timing of fuel delivery and the timing of the opening and closing of said valves, an engine driven driving component drivingly connected to said camshaft and a fuel delivery timing regulator between said component and said camshaft operative to adjust the rotative angle of said camshaft relative to said driving component in response to changes in engine speed to obtain optimum fuel delivery throughout the engine speed range, said cams being constructed and arranged relative to each other so that the intake and exhaust valve timing, effected by the fuel delivery timing regulator control of the rotative angle of the camshaft, is optimum only at the engine speed at which maximum engine torque is delivered.

* * * * *